United States Patent [19]

Hovorka et al.

[11] Patent Number: 4,520,712

[45] Date of Patent: Jun. 4, 1985

[54] AXIAL PISTON MACHINE HAVING A SEALED BEARING BOX

[75] Inventors: Reiner Hovorka, Wuppertal; Josef Riedhammer, Horb a. Neckar, both of Fed. Rep. of Germany

[73] Assignee: Hermann Hemscheidt Maschinenfabrik GmbH & Co., Wuppertal, Fed. Rep. of Germany

[21] Appl. No.: 547,566

[22] Filed: Nov. 1, 1983

[30] Foreign Application Priority Data

Sep. 10, 1982 [DE] Fed. Rep. of Germany ..... 3233579

[51] Int. Cl.[3] ..... F01B 13/04

[52] U.S. Cl. ..... 91/505; 91/499; 417/269

[58] Field of Search ..... 91/486–488, 91/499, 504–506; 384/139; 308/187.1; 417/269

[56] References Cited

U.S. PATENT DOCUMENTS

| | | | |
|---|---|---|---|
| 2,113,167 | 4/1938 | Baumheckel | 384/139 |
| 2,157,692 | 5/1939 | Doe et al. | 91/499 X |
| 2,495,685 | 1/1950 | Beaman et al. | 417/270 X |
| 2,911,241 | 11/1951 | Horvath et al. | 308/187.1 |
| 3,274,950 | 9/1966 | Thoma | 91/488 X |
| 3,311,430 | 3/1967 | Christensen et al. | 308/187.1 |
| 3,457,873 | 7/1969 | Fischer et al. | 91/499 X |
| 3,643,550 | 2/1972 | Lease | 91/506 |
| 3,693,508 | 9/1972 | Chondzinski | 91/499 |
| 4,382,399 | 5/1983 | Lotter | 91/499 X |

FOREIGN PATENT DOCUMENTS

| | | | |
|---|---|---|---|
| 2152568 | 4/1972 | Fed. Rep. of Germany | 91/499 |
| 163174 | 10/1982 | Japan | 91/499 |

*Primary Examiner*—William L. Freeh
*Assistant Examiner*—Paul F. Neils
*Attorney, Agent, or Firm*—Berman, Aisenberg & Platt

[57] ABSTRACT

A rotating drum-shaped cylinder block with pistons longitudinally displaceable in the cylinder bores is mounted in the housing of a reciprocating-piston pump of inclined-disc construction. The cylinder block is fitted on the free end of a rotating driving shaft which, in a median zone along its length, is mounted on two roller bearings in a bearing box which is completely sealed off from the machine housing. The pistons are supported in piston shoes on a stationary inclined disc the inclined position of which can be adjusted in the machine housing. For the purpose of sealing off the machine housing from the bearing box, there are slide-ring sealing means composed of a rotating ring secured to the driving shaft and of a stationary ring in the machine housing.

6 Claims, 1 Drawing Figure

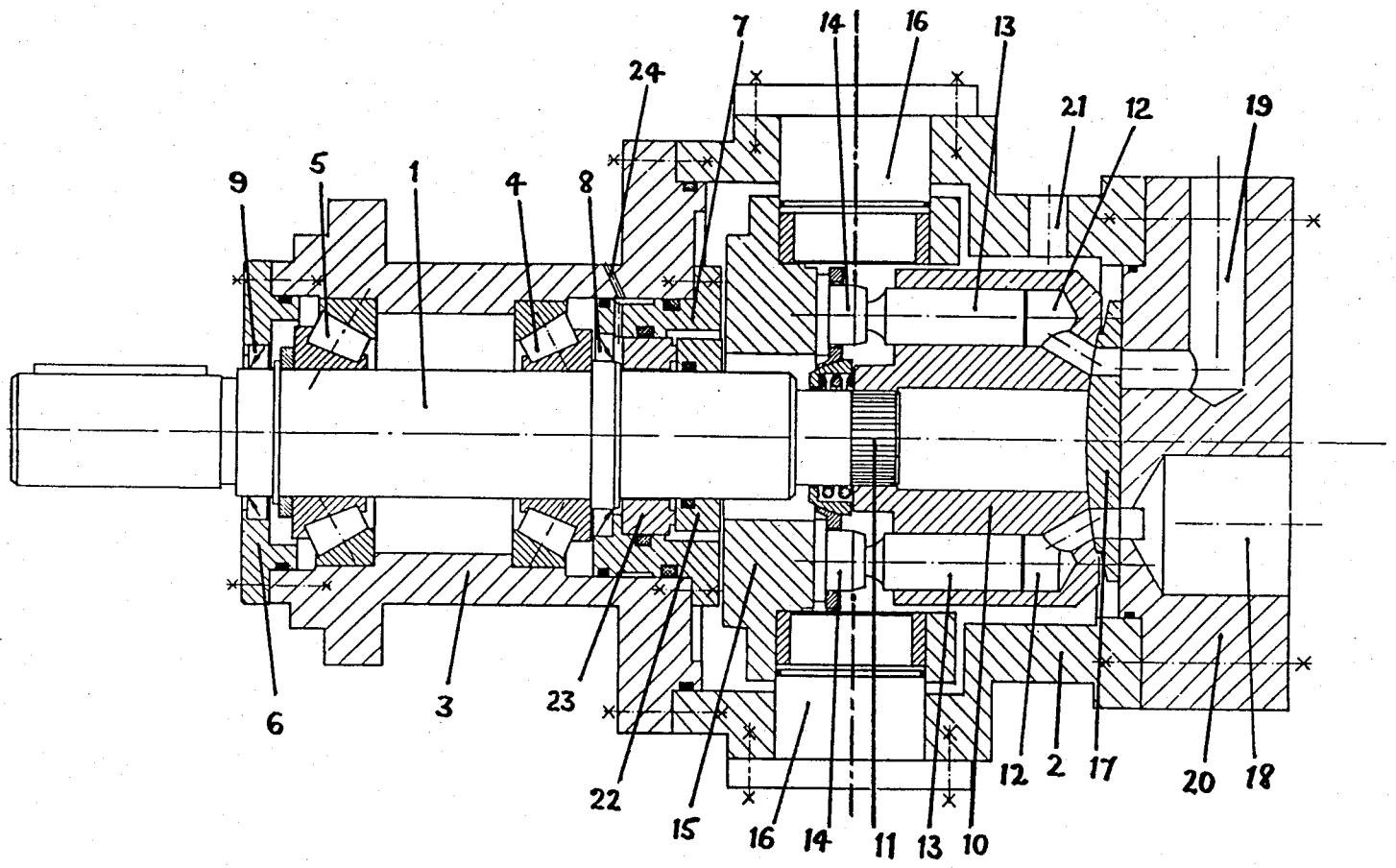
19
12
21
13
16
14
7
24
8
4
1
5
9
18
20
17
2
12
10
13
11
14
16
15
22
23
3
6

AXIAL PISTON MACHINE HAVING A SEALED BEARING BOX

This invention relates to machines such as pumps having pistons which extend longitudinally of the machine, the pistons being arranged to cooperate with a disc of variable inclination.

In such machines, the pistons are not sealed off in their respective cylinders by sealing elements capable of preventing leakage as a certain degree of leakage is necessary for lubricating the slide faces of the pistons. A certain quantity of the liquid medium being pumped or otherwise conveyed through the machine therefore flows continuously into the machine housing through a leakage gap between each piston and its cylinder wall, and this liquid is then returned from the housing to a tank or other reservoir for the liquid. The volume of the leakage flow is dependent upon various factors and, with regard to the present invention, particularly upon the viscosity of the liquid medium being conveyed. If, for example, a low-viscosity medium such as water or "HFA liquid" (95–97% water, 5–3% lubricating additive) is to be delivered by means of a pump, there then arises the particular problem of sealing off the extremely sensitive bearings of the driving shaft, which bearings require particularly careful lubrication in the case of high-duty pumps. However, the sealing-off, against water, of the shaft bearings arranged in the machine housing at that end of the driving shaft opposite the input end is very expensive and leads to an undesirable increase in the length and volume of the whole structure, since the increase in the width between the shaft supports results in greater deflection of the shaft which must therefore be strengthened. High-duty reciprocating-piston machines of the inclined disc form of construction have not therefore hitherto been used for delivering water or other low-viscosity media.

It is already known to mount the driving shaft of the cylinder block of reciprocating-piston machines in roller bearings. The cylinder block, which is connected to the driving shaft in a shape-locking and/or force-locking manner, is then additionally supported internally (as in German Patent No. 829 553) or externally of the generating surface (as in German Published Patent Application No. 21 14 923) by means of roller bearings or friction bearings. Sealing-off of the bearings against leakage fluid in the housing is not provided for. Consideration cannot therefore be given to this form of machine when HFA liquid is the delivery medium.

It is also known to seal off the housings of reciprocating-piston machines at one end of the driving shaft, which is mounted at its two ends within the machine housing, by means of a slide-ring seal which comprises a rotating ring on the driving shaft which co-operates with a stationary ring in the engine housing (see U.S. Pat. Nos. 3 643 550 and 2 495 685). In this case also there is no provision for sealing off the bearings against the leakage fluid.

For the purpose of operating reciprocating-piston pumps using HFA fluids, it has been proposed to encapsulate the roller bearings completely by means of a permanent lubricating system and therefore also to separate the shaft (which extends right through the machine housing) as well as the clutch located in the same zone from the hydraulic fluid (o+p "ölhydraulik und penumatik" 22 (1978) No. 1, pages 16 to 18). However, the construction of the pump is rendered very complicated by the encapsulation of the two bearings of the shaft.

The object of the invention is to provide a simple form of piston machine of the inclined disc construction which is suitable for delivering low-viscosity media.

According to the invention, this object is achieved by constructing a reciprocating piston machine in accordance with claim 1 of the appended claims.

A machine, such as a pump, in accordance with the invention therefore comprises a box for the bearings of the driving shaft and a separate housing for accommodating the pump body. The delivery medium and the shaft bearings are accordingly accommodated in spaces which are separated from each other and sealed off independently of each other. Thus, shaft seals can be used for sealing off the bearing box, which is filled with a suitable lubricant such as grease for lubricating the bearings, whereas, for the purpose of sealing off the machine housing, filled with leakage fluid, from the driving shaft, use is made of slide-ring sealing means having a stationary ring and a rotating ring which slide one over the other in a fluid-tight manner.

In addition to this, the operationally-effective forces are divided in an advantageous manner, since all axial forces are transmitted to the machine housing so that the roller bearings in the bearing box are subjected only to radial forces. The compact space-saving construction permits simple assembly and dismantling involving no problems, since after the screws-bolts which connect the housing and the box to each other have been loosened, the pump body accommodated in the machine housing can be simply pulled off the driving shaft.

An embodiment of the invention is shown by way of example in the accompanying drawing which shows, in longitudinal section, a reciprocating-piston pump of the inclined disc form of construction.

The driving shaft 1 of the illustrated reciprocating-piston pump is mounted outside the pump housing 2 is a separate bearing box 3 and is supported on two roller bearings 4 and 5 in a median zone along its length. The bearing box 3 is closed off at the input end by a bearing cover 6 and, at the end adjacent the pump housing 2, by a flanged bush 7, and is sealed off by radial shaft-sealing means 8 and 9 fitted in the bearing box. The bearing box 3 is filled with a suitable lubricant for the roller bearings 4 and 5.

The driving shaft 1 drive's a drum-shaped cylinder block 10 in the pump housing 2. For this purpose, the free end of the driving shaft 1 projecting into the pump housing 2 is provided with notched teeth 11 which mesh with corresponding teeth on the inner wall of the cylinder block 10.

A plurality of longitudinally-extending cylinder bores 12 are formed in the cylinder block 10 and are arranged in a circle around the axis of rotation at similar angular distances. Provided in each cylinder bore 12 is a longitudinally-displaceable piston 13 which, by means of a piston shoe 14, is supported by and slides over a stationary inclined disc 15, independently of the driving shaft 1, which extends centrally through the system with lateral clearance, the inclined disc is mounted in the pump housing on pins 16 arranged at right angles, the angle of inclination of the disc 15 being adjustable.

When the cylinder block 10 is caused to rotate, the inclined disc 15 imparts a reciprocating movement to the pistons 13 in their associated cylinder bores 12. At one of its ends the cylinder block 10 bears against a stationary control plate 17 which has a part-spherical face and in which are formed two control openings of kidney-shaped cross-section. When the cylinder block 10 is rotating, the piston-displacement spaces in the cylinder chambers 12 are alternately connected, through the openings in the control plate 17, to a suction duct 18 and a compression duct 19 in the adjacent connecting cover 20 which closes off the pump housing 2 from the exterior.

Between each cylinder bore 12 and piston 13 is formed a leakage gap through which a small proportion of delivery medium passes from the cylinder block 10 into the pump housing 2 as each compression stroke takes place. This leakage fluid is returned by way of the leakage connection 21 to a tank or other reservoir (not illustrated). The pump housing 2 is sealed off from the bearing box 3 by slide-ring sealing means 22, 23, the rotating ring 22 of which is secured to the driving shaft 1, while the stationary ring 23 is fitted in the bush 7 disposed opposite the inclined disc 15. The space between the radial-shaft seal 8 which seals off the bearing box 3 and the stationary ring 23 associated with the slide ring sealing means 22, 23 which seal off the engine housing 2 communicates with an outwardly-extending air-vent duct 24. The housing 2 is bolted on the outside to the bearing box 3 in the zone of the slide-ring sealing means 22, 23.

We claim:

1. A reciprocating-piston machine of the inclined disc type, comprising a rotatable driving shaft, a drum-shaped cylinder block directly connected thereto for rotation with said shaft and arranged in a housing of the machine, cylinder bores in said block disposed in a circle around the axis of rotation of said driving shaft, longitudinally-displaceable pistons in said cylinder bores, piston shoes connected to said pistons and supported on a stationary inclined disc swivellably adjustable in the machine housing, a control plate at the end of the cylinder block remote from the inclined disc serving to connect the cylinder bores alternately to a suction duct and a pressure duct for fluid medium to be conveyed through the machine, a bearing box located outside the machine housing and surrounding an intermediate part of the driving shaft lying outside the machine housing, two spaced-apart roller bearings in the bearing box serving as the sole means of support for the driving shaft, the cylinder block being mounted on the free end of the bearing-free portion of the driving shaft lying within the machine housing, and slide-ring sealing means adapted to seal the machine housing from the bearing box, the said sealing means including a rotating ring tightly surrounding and directly secured to the driving shaft and arranged to bear in a fluid-tight manner against a stationary ring inserted in a bush associated with the bearing box.

2. A machine according to claim 1, in which the machine housing and the bearing box are formed as separate components and are interconnected in the region of the slide-ring sealing means.

3. A machine according to claim 1, in which the free end of the driving shaft engages, by way of notched teeth, with corresponding teeth in the cylinder block.

4. A machine according to claim 1, in which the cylinder block bears at one of its end-faces against a control plate having a surface of part-spherical shape.

5. A machine according to claim 1, in which the roller bearings take the form of tapered roller bearings.

6. A reciprocating-piston machine of the inclined disc type, comprising a rotatable driving shaft, a drum-shaped cylinder block directly connected thereto for rotation with said shaft and arranged in a housing of the machine, cylinder bores in said block disposed in a circle around the axis of rotation of said driving piston shoes connected to said pistons and supported on a stationary inclined disc swivellably adjustable in the machine housing, a control plate at the end of the cylinder block remote from the inclined disc serving to connect the cylinder bores alternately to a suction duct and a pressure duct for fluid medium to be conveyed through the machine, a bearing box located outside the machine housing and surrounding an intermediate part of the driving shaft lying outside the machine housing, two spaced-apart roller bearings in the bearing box serving to support the driving shaft, slide-ring sealing means adapted to seal the machine housing from the bearing box, the said sealing means including a rotating ring tightly surrounding and directly secured to the driving shaft and arranged to bear in a fluid-tight manner against a stationary ring inserted in a bush associated with the bearing box, radial shaft sealing means on both sides of the roller bearings in the bearing box, and an outwardly-directed air-vent duct communicating with a space between the said radial shaft sealing means and the stationary ring of the slide-ring sealing means.

* * * * *